United States Patent [19]

Diegelman

[11] Patent Number: 4,601,318

[45] Date of Patent: Jul. 22, 1986

[54] CAMERA AND LENS CASE

[76] Inventor: David Diegelman, P.O. Box 1631, Grass Valley, Calif. 95945

[21] Appl. No.: 592,349

[22] Filed: Mar. 22, 1984

[51] Int. Cl.[4] ..... G03B 17/00; A45C 11/38

[52] U.S. Cl. ..... 150/52 J; 206/316

[58] Field of Search ..... 150/52 J, 52 R; 206/316

[56] References Cited

U.S. PATENT DOCUMENTS

| | | | |
|---|---|---|---|
| 3,828,991 | 8/1974 | Moore | 206/316 X |
| 4,033,392 | 7/1977 | Less | 150/52 J |
| 4,071,066 | 1/1978 | Schaeffer | 150/52 J |
| 4,136,726 | 1/1979 | Lee | 150/52 J |
| 4,172,485 | 10/1979 | Mathieu | 206/316 X |
| 4,176,701 | 12/1979 | Welgan | 150/52 J |
| 4,232,808 | 11/1980 | Gray | 150/52 J X |
| 4,383,565 | 5/1983 | Denmat | 150/52 J |

FOREIGN PATENT DOCUMENTS

| | | | |
|---|---|---|---|
| 1155321 | 10/1963 | Fed. Rep. of Germany | 150/52 J |
| 142649 | 7/1980 | Fed. Rep. of Germany | 206/316 |
| 1319363 | 1/1963 | France | 150/52 J |

*Primary Examiner*—William Price
*Assistant Examiner*—Sue A. Weaver
*Attorney, Agent, or Firm*—Willis E. Higgins

[57] ABSTRACT

A camera case (10) has a camera body enclosing portion (12) and a lens enclosing portion (14). The portions (12) and (14) are joined by means of ring assembly (16) which permits the lens enclosing portion (14) to rotate with respect to the camera enclosing portion (12) while the two portions are joined together. A flexible fabric section (62) joins the ring assembly (16) to the remainder of the lens enclosing portion (14).

5 Claims, 4 Drawing Figures

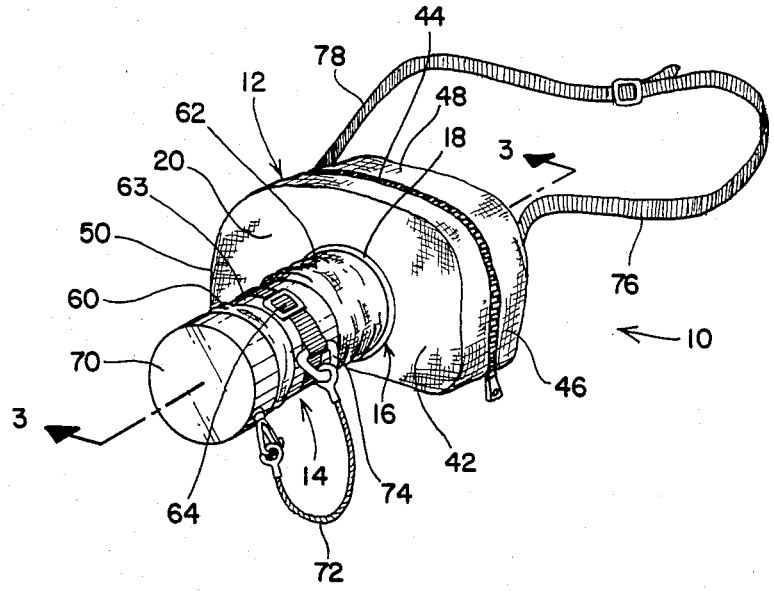
FIG. 1
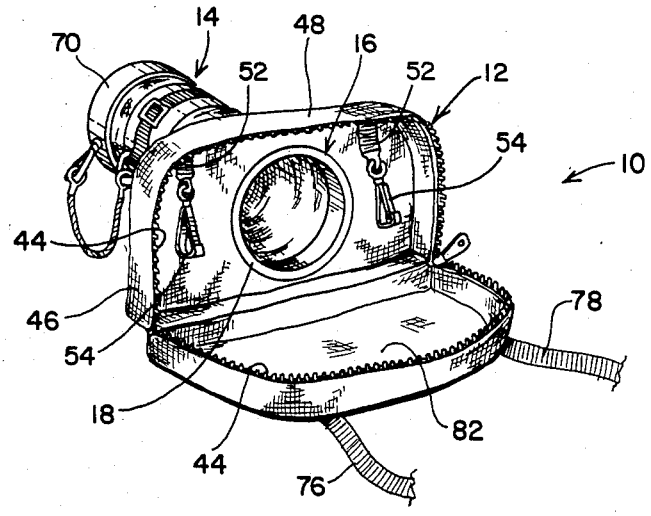
FIG. 2
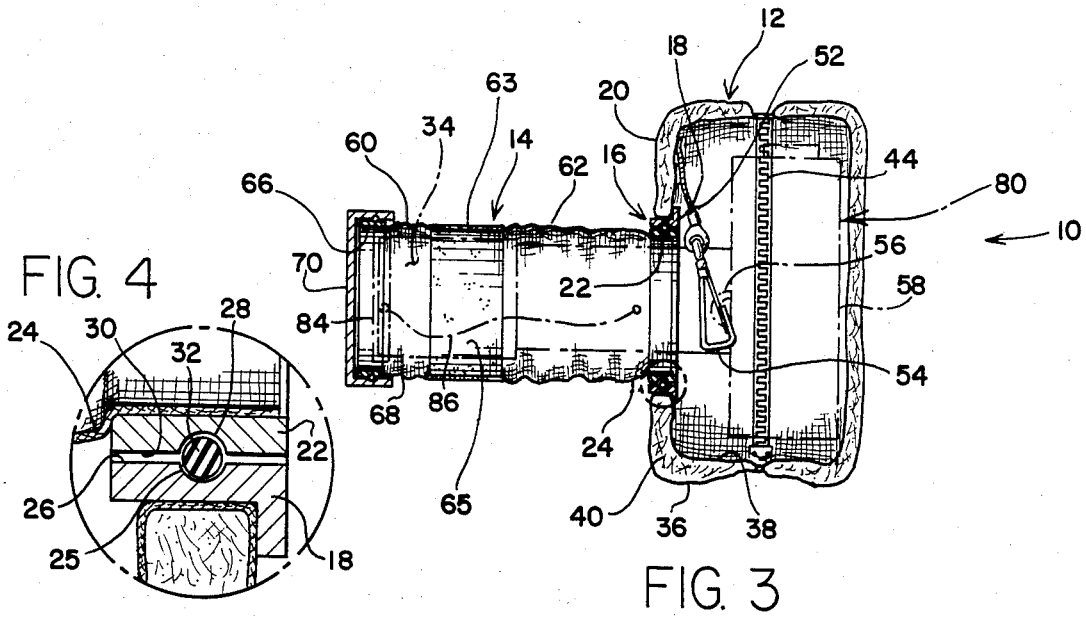
FIG. 4
FIG. 3

CAMERA AND LENS CASE

BACKGROUND OF THE INVENTION

1. Field of the Invention.

This invention relates to a novel case which holds both a camera body and a lens. More particularly, it relates to such a case which allows both the camera and the lens to be operated without removing either the camera or the lens from the case. Most especially, it relates to such a camera case which allows the camera and lens to be operated while keeping the camera secured to the body of the user.

2. Description of the Prior Art.

There are a variety of camera cases known in the prior art which will hold both a camera body and a lens attached to the camera body. Examples of such camera cases are disclosed in the following issued U.S. Pat. Nos. 4,172,485, issued Oct. 30, 1979 to Mathieu and 4,383,565, issued May 17, 1983 to Denmat. However, these prior art camera cases require that the portion of the cases covering the lens be removed in order to allow focusing and other operation of the lens. These prior art cases therefore have limited application for use when a photographer is executing a technical climb or is engaged in other strenuous activity.

SUMMARY OF THE INVENTION

It is an object of this invention to provide a camera case within which a camera may be operated while being secured to the body of the operator while the operator is engaged in technical climbing or similar strenuous activity.

It is another object of the invention to provide a camera and lens case which allows both the camera and the lens to be adjusted and used without removing either from the case and without exposing either to inclement weather.

It is a further object of the invention to provide a case for a camera and lens in which the camera and lens can each be adjusted and used while maintaining each secured to the body of the user.

The attainment of these and related objects may be achieved through use of the novel camera and lens case herein disclosed. A camera case in accordance with this invention has a camera body enclosing portion with an openable back. A lens enclosing portion is attached to a front of the camera body enclosing portion by a circumferential end connection which allows the lens enclosing portion to be rotated relative to the camera body enclosing portion of the case. A flexible band joins the circumferential end connection to the remainder of the lens enclosing portion. Straps may be attached to both the camera body enclosing portion and the lens enclosing portion of the case to secure both portions of the case to the body of a user. In use, the lens of a camera in the case may be focused and zoomed without removing the lens enclosing portion of the case from the lens.

The attainment of the foregoing and related objects, advantages and features of the invention should be more readily apparent to those skilled in the art, after review of the following more detailed description of the invention, taken together with the drawings, in which:

BRIEF DESCRIPTION OF THE DRAWINGS

FIG. 1 is a perspective view of a camera case in accordance with the invention.

FIG. 2 is a another perspective view of the camera case shown in FIG. 1.

FIG. 3 is a cross section view taken along the line 3—3 in FIG. 1.

FIG. 4 is an enlarged view of a portion of the cross section view in FIG. 3.

DETAILED DESCRIPTION OF THE INVENTION

Turning now to the drawings, more particularly to FIGS. 1-3, there is shown a camera case 10 in accordance with the invention. The case 10 includes a camera body holding portion 12 and a lens holding portion 14. The portions 12 and 14 are releasably fastened together by means of a separable ring fastening assembly 16. The assembly 16 (best shown in FIG. 4) consists of a first ring 18 fixedly attached to front 20 of the camera body holding portion 12. A second ring 22 is dimensioned for a friction fit within the first ring 18. The second ring 22 is fixedly attached to end 24 of the lens holding portion 14. First ring 18 has a circumferential groove 25 around its inner surface 26. Second ring 22 also has a circumferential groove 28 around its outer surface 30. An O-ring 32 is mounted on the second ring 22 in the groove 28. When the rings 18 and 22 are together, the O-ring 32 also fits into the groove 25.

In use, the camera holding portion 12 and the lens holding portion of the case 10 are easily separated by applying a force normal to the front 20, without rotation of either ring 18 or 22. Rings 18 and 22 are free to rotate with respect to one another, due to the presence of O-ring 32, when the rings are together. Such rotation allows lens 34 within the lens holding portion 12 to be focused without removing it from the lens holding portion.

The camera holding portion 12 of the case 10 is formed from two layers 36 and 38 of waterproof Cordura nylon fabric on either side of a cushioning layer 40. Front 20 of the camera body holding portion 12 has a reinforcing layer 42 of canvas stitched over the nylon layers 36 and 38. A zipper 44 extends around three sides 46, 48 and 50 of the portion 12 to allow access to the interior of the portion 12. Inside the portion 12, loops 52 sewn into the portion 12 and fasteners 54 attach to rings 56 on camera body 58 to hold the camera body 58 securely within the portion 12.

The lens holding portion 14 of the case 10 is formed from waterproof Cordura nylon fabric sections 60 and 62 and a middle section 63 of stiffer canvas. There is also a cushioning strip 65 formed from foamed resilient polypropylene or other suitable plastic material, coextensive with the middle section 63, on the interior of the portion 14. An adjustable strap 64 is attached to the middle section 63 of the portion 14, in order to allow the portion 14 to be adjusted for different diameter lenses. It is important that the fabric section 62 be flexible, so that the rest of the lens holding portion 14 can be moved toward and away from the front 20 of the camera body holding portion during use of zoom lens 34. The lens holding portion 14 has a rigid ring 66 attached to its front end 68, to receive a removable cap 70. The cap 70 is attached to the strap 64 by means of line 72 and ring 74.

Straps 76 and 78 are used to attach the case 10 to a user's body. In use of the camera 80, back 82 of the camera body holding portion is opened with zipper 44 to allow access to the camera 80. Cap 70 is removed from the lens holding portion 14, and lens cap 84, also attached to lens 34 by line 86, is also removed. Lens holding portion 14 is rotated by turning second ring 22 relative to first ring 18 as necessary to focus lens 34. Sections 60 and 63 of the lens holding portion 14 are also moved closer or further from front 20 of the camera body holding portion 12 as necessary to zoom the lens 34. Should it be necessary to observe markings on the lens 34, the rings 18 and 22 can be temporarily separated and the section 62 pushed forward for this purpose. In this manner of operation, camera 80 and lens 34 need never be removed from the case 10 during operation, and they therefore remain secure at all times against dropping and against damage from moisture during inclement weather.

It should now be readily apparent to those skilled in the art that a novel camera and lens case capable of achieving the stated objects of the invention has been provided. The camera case of this invention allows both the camera and lens to be adjusted and used without requiring that either be removed from the case. The camera and lens are therefore protected during use while executing a technical climb or other strenous activity and during inclement weather.

It should be further apparent to those skilled in the art that various changes in form and details of the invention as shown and described may be made. It is intended that such changes be included within the spirit and scope of the claims appended hereto.

What is claimed is:

1. A camera case comprising a camera body enclosing portion with an openable back, a lens enclosing portion, a connection joining said camera body enclosing portion and said lens enclosing portion which allows said lens enclosing portion to rotate with respect to said camera body enclosing portion while remaining attached to said camera body enclosing portion, said lens enclosing portion having a flexible band joining said connection and a remainder of said lens enclosing portion, said lens enclosing portion being attached to said body enclosing portion by means of a pair of friction fitting rigid rings having a grooved region therebetween for insertion of an O-ring, and an O-ring in the grooved region.

2. The camera case of claim 1 additionally comprising a substantially stiffer band surrounding a lens in said lens enclosing portion, with the flexible band between the stiffer band and the pair of rings.

3. The camera case of claim 2 additionally comprising a cushioned layer surrounding a lens in said lens enclosing portion.

4. The camera case of claim 3 additionally comprising an additional flexible band in said lens enclosing portion in front of the substantially stiffer band.

5. The camera case of claim 4 additionally comprising straps for connecting said lens enclosing portion and said camera body enclosing portion to a person transporting the camera.

* * * * *